US005195560A

United States Patent [19]

Achmad

[11] Patent Number: 5,195,560

[45] Date of Patent: Mar. 23, 1993

[54] ADJUSTABLE LOW FREQUENCY HYDROFLUIDIC OSCILLATOR

[76] Inventor: Muchlis Achmad, 27565 N. Artine Dr., Santa Clarita, Calif. 93150

[21] Appl. No.: 874,248

[22] Filed: Apr. 27, 1992

[51] Int. Cl.[5] ..... F15C 3/04

[52] U.S. Cl. ..... 137/826; 137/835; 137/840; 91/308

[58] Field of Search ..... 137/825, 826, 835, 840, 137/804, 814; 91/461, 307, 308, 3

[56] References Cited

U.S. PATENT DOCUMENTS

| | | | |
|---|---|---|---|
| Re. 27,352 | 5/1972 | Stern | 91/3 |
| 3,124,999 | 3/1964 | Woodward | 137/835 |
| 3,340,896 | 9/1967 | Mon et al. | 91/307 |
| 3,444,877 | 5/1969 | Atchley . | |
| 3,516,763 | 6/1970 | Manton | 91/318 |
| 3,568,702 | 3/1971 | Dustin . | |
| 3,575,209 | 4/1971 | Kast | 137/804 |
| 3,682,042 | 8/1972 | Bain | 91/308 |
| 3,885,591 | 5/1975 | O'Keefe | 137/826 |
| 4,002,103 | 1/1977 | Martin | 91/308 |
| 4,256,015 | 3/1981 | Tippetts et al. | 137/829 |
| 4,508,127 | 4/1985 | Thurston | 137/835 |
| 4,757,747 | 7/1988 | Blatter et al. | 91/363 R |

FOREIGN PATENT DOCUMENTS 545777 10/1974 U.S.S.R. .

*Primary Examiner*—A. Michael Chambers

*Attorney, Agent, or Firm*—Robbins, Dalgarn, Berliner & Carson

[57] ABSTRACT

A hydrofluidic oscillator including a momentum exchange fluidic amplifier coupled to a four-way reciprocal valve. The four-way valve is connected to control flow of hydraulic fluid from a source thereof to a using apparatus. The fluidic amplifier is connected to provide input signals to the four-way valve to cause the four-way valve to reciprocate responsive to the input signals. Both negative and positive feedback paths are provided from each outlet of the fluidic amplifier to the respective control ports to control oscillation of the four-way valve.

11 Claims, 1 Drawing Sheet

ADJUSTABLE LOW FREQUENCY HYDROFLUIDIC OSCILLATOR

BACKGROUND OF THE INVENTION

1. Field of the Invention

The present invention relates generally to fluid oscillators and more particularly to a low frequency hydrofluidic oscillator.

2. Prior Art

Fluid oscillators utilizing fluidic amplifiers along with a piston housed in a fluid receiving chamber to provide output pulses or flows of fluid responsive to oscillation of the fluidic amplifier are known. For example, such a structure is shown in U.S. Pat. No. 3,124,999. Although the frequency of oscillation of the output signal can be changed such can only be accomplished by mechanically changing the length and mass of the piston or the spacing of the ports which are alternately covered and uncovered by movement of the piston.

Other types of fluidic amplifier driven oscillators are controlled by mechanically opening or closing feedback passageways connected to the control ports of the fluidic amplifier. Such devices are shown in U.S. Pat. No. 3,340,896.

Other types of structures are such as is shown in Re. 27,352 wherein tuned resonant devices such as tuned cavities control the frequency of the fluidic amplifier.

Other pneumatic oscillators known to Applicant are those as shown in U.S. Pat. No. 3,568,702 and U.S. Pat. No. 3,682,042. In U.S. Pat. No. 3,568,702, a pure fluidic oscillator is disclosed wherein the oscillator comprises three bistable fluid amplifiers with interconnecting R-C circuits and wherein the control signal pressure is applied to the oscillator through additional fluidic conditioning circuits which control the frequency range of the oscillator. In U.S. Pat. No. 3,682,042 a motor suitable for driving reciprocatory stirrers or the like is directly driven by a bistable fluidic amplifier, the frequency of which is controlled by blocking a vent at the end of movement of a piston.

Although each of the oscillators known to Applicant as above briefly described operate adequately for the purpose intended, none utilize a fluidic amplifier to drive a reciprocal valve to in turn provide an output fluid signal the frequency of which is adjustable and is in a low frequency range that is much lower than the natural frequency of the fluidic amplifier.

SUMMARY OF THE INVENTION

An adjustable low frequency hydrofluidic oscillator which includes a momentum exchange fluidic amplifier which drives a reciprocal valve means to provide discreet output fluid pulses. Reciprocation of the valve means is controlled by the simultaneous application of positive and negative fluid pressure feedback signals to the control ports of the fluidic amplifier.

DETAILED DESCRIPTION OF THE PREFERRED EMBODIMENT

Figure 1:
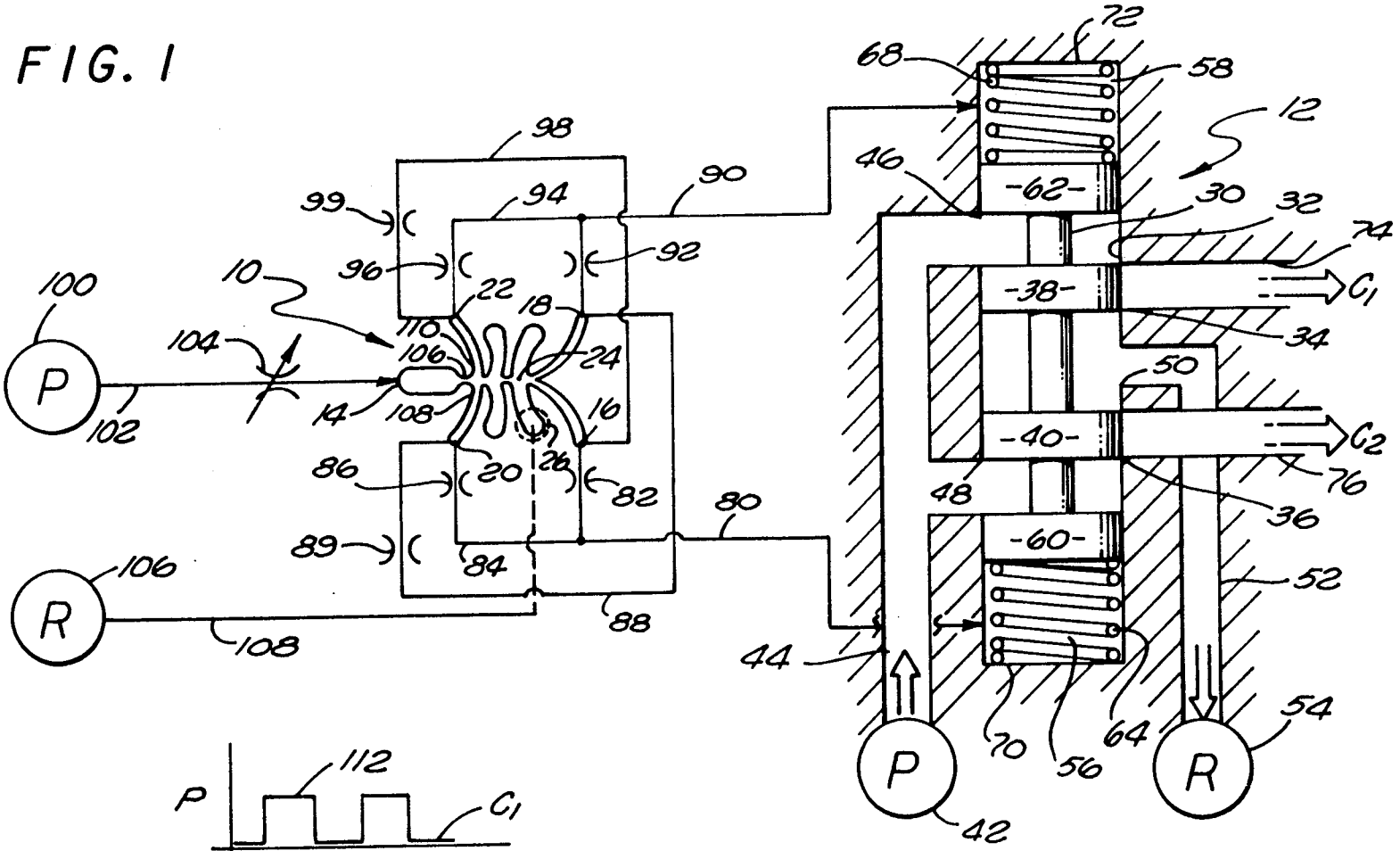
FIG. 1 is a schematic diagram illustrative of a hydrofluidic oscillator constructed in accordance with the principles of the present invention.

Referring to FIG. 1, a hydrofluidic oscillator constructed in accordance with the principles of the present invention is shown as including a momentum exchange fluidic amplifier 10 coupled to a reciprocal valve means 12 such as a four-way spool valve. The momentum exchange fluidic amplifier 10 is of a construction well known to those skilled in the art and includes an input port 14, first and second output ports 16 and 18 and first and second control ports 20 and 22. Also included is an interaction chamber 24 which includes an exhaust port 26. As is well known to those skilled in the art, a momentum exchange fluidic amplifier includes devices in which two or more streams interact in such a way that one or more of these streams (the control stream) deflects another stream (the power stream) with little or no interaction between the side walls of the interaction chamber and the streams themselves. The power stream deflection in such a momentum exchange fluidic amplifier is continuously variable in accordance with the control signal amplitude. In a fluidic amplifier of this type, the detail contours of the side walls of the interaction chamber are of secondary importance to the interacting forces between the streams themselves. Although the side walls of such devices can be used to contain fluid in the interacting chamber and thus make it possible to have the streams interact in a region at some desired ambient pressure, the side walls are so placed that they are somewhat removed from the high velocity portions of the interaction streams and the power stream does not approach or attach to the side walls.

The reciprocal valve means 12 includes a spool 30 which is reciprocally disposed within a bore 32. As the spool 30 reciprocates within the bore 32, output ports 34 and 36 are controlled by lands 38 and 40, respectively, on the spool 30. By such movement, fluid under pressure such as hydraulic fluid from the source 42 is caused to flow through passageway 44 and input ports 46 and 48, respectively, and then through either output port 34 or 36 depending upon the direction of movement of the valve 30. Return port 50 is connected by passageway 52 to sump or return 54. As is well known to those skilled in the art, in a closed hydraulic system as fluid flows from one control port to a load device (not shown), the fluid also flows from the load device to the return port and then to return 54. End chambers 56 and 58 are defined by end lands 60 and 62 of the spool 30 and the end walls 70 and 72 of the bore 32. Disposed within the chambers 56 and 58 are springs 64 and 68 which, in the absence of fluid pressure signals applied to the chambers 56 and 58, will center the spool 30 in the null position as is illustrated in FIG. 1.

If a fluid pressure signal is applied to chamber 58, the spool 30 is caused to move downwardly as viewed in FIG. 1 thus causing land 38 to open port 34 and allow fluid under pressure from source 42 to flow through passageway 74 and appear as output signal $C_1$. Alternatively, if a fluid pressure signal is applied to the chamber 56, the spool 30 moves upwardly as viewed in FIG. 1 causing land 40 to open port 36 to hydraulic fluid under pressure from the source 42 allowing it to flow through the passageway 76 and appear as signal $C_2$. As will be recognized to those skilled in the art, when fluid under pressure is flowing through passageway 74 or 76, return 54 is connected to the other of passageway 74 or 76.

A first passageway means 80 couples the amplifier 10 output port 16 through the restriction orifice 82 to apply fluid pressure signals rom the fluidic amplifier 10 to the chamber 56. The outlet port 16 is also coupled through the passageway 84 and the restriction orifice 86 to the control port 20 of the fluidic amplifier 10. The output port 18 is also coupled to the control port 20 by the passageway means 88 which includes the restriction orifice 89.

The output port 18 of the fluidic amplifier 10 is coupled by the second passageway 90 through the restriction orifice 92 to the chamber 58 of the reciprocal valve means 12. The output port 18 is also coupled by way of the passageway 94 and the restriction orifice 96 to the control port 22. In addition, the passageway 98 intercouples the output port 16 of the fluid amplifier through the restriction orifice 99 to the control port 22 thereof.

Fluid pressure such as compressed air is provided from a source 100 through a passageway means 102 and a variable restriction orifice 104 to the supply port 14 of the amplifier 10. A return sump 106 or ambient is connected by passageway 108 to the exhaust port 26 of the interaction chamber 24.

When fluid under pressure such as compressed air is applied from the source 100 to the input port 14, such passes through the input nozzle 106 to provide a power stream or jet into the interaction chamber 24. Depending upon the pressures appearing at the control nozzles 108–110, the power stream will be deflected so as to appear as an outlet pressure signal at the outlet port 16 or 18. If the pressure signal appears at the output port 16, it should be noted that it is applied simultaneously to the chamber 56 via the passageway 80, to the control port 20 via the passageway 84 as a negative feedback signal, and to the control port 22 via the passageway 98 as a positive feedback signal. Alternatively, if the output pressure signal appears at the output port 18, it will simultaneously be applied to the chamber 58 via the passageway 90, to the control port 22 via the passageway 94 as a negative feedback signal, and to the control port 20 via the passageway 88 as a positive feedback signal.

The restriction orifice 82 and the chamber 56 connected to the output port 16 of the fluidic amplifier 10 function as a resistance and capacitance, respectively, and thus as an R-C circuit, similarly the restriction orifice 92 will act as a resistance and the chamber 58 as a capacitance connected to the output port 18 and will also function as an R-C circuit. At a given input pressure and resistance value of variable restrictor 104, a desired frequency of oscillation of between 0.5 and 5 Hertz may be obtained through appropriate sizing of the R-C circuits as well as the restrictors in the feedback paths.

OPERATION

The operation of the hydrofluidic oscillator as above described is such that when a fluid pressure signal is applied from the fluidic amplifier 10 to one of the chambers, the spool valve 30 moves responsive thereto providing an output hydraulic signal pulse. During this time, a positive feedback signal is applied to the appropriate control port and is initially dominant and therefore functions to enhance the output signal appearing at the output port of the fluidic amplifier. When the chamber becomes full (the capacitance is fully charged), the fluid pressure signal from the output port which has been applied to the opposite control port as a negative feedback signal becomes dominant and therefore functions to cause the power stream to deflect to the other output port thereby reversing the positioning of the spool valve to provide an output hydraulic signal at the opposite output port of the reciprocating valve 12. The frequency of the oscillation can be controlled by the variable restriction orifice 104 or alternatively, by changing the size of the chambers or the spring rate of the springs in the reciprocal valve 12.

Figure 2:
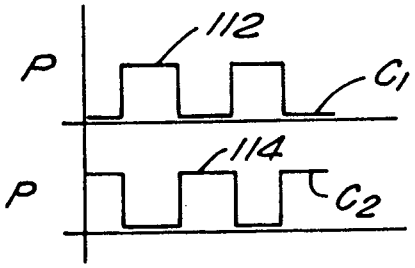
FIG. 2 is a wave form showing the output signals generated by the oscillator of FIG. 1.

Assume for purposes of further detailed discussion that the power stream is deflected such that it appears as an output signal at the output port 18 of the fluidic amplifier 10. The pressure signal passes through the restriction orifice 92 and the passageway 90 to enter the chamber 58. Simultaneously, the signal passes through the passageway 88 and the restriction orifice 89 and is applied as a positive feedback signal to the control port 20. The resistance provided by the restriction orifice 89 is greater than that provided by the restriction orifice 92. Simultaneously, the signal at the outlet of the restriction orifice 92 is applied by the passageway 94 and through the restriction orifice 96 as a negative feedback signal to the control port 22. This negative feedback signal has little initial effect because there is less resistance to the flow of the fluid through the passageway 90 and into the chamber 58 than through the restriction orifice 96 and to the control port 22. As a result, the fluid pressure signal from the output port 18 simultaneously provides a dominant positive feedback signal to the control port 20 and commences filling the chamber 58. As the chamber 58 is filled with the fluid under pressure, the valve 30 moves downwardly as viewed in FIG. 2 causing land 38 to open flow port 34 to provide an output hydraulic signal at $C_1$ as is shown at 112 in FIG. 2. At the same time, the land 40 opens flow port 36 and connects passageway 76 ($C_2$) to return 54 so that any hydraulic fluid which is resident in a motor or other using apparatus (not shown) connected to the passageway 74 and 76 may return to the system. As is well known to those skilled in the art, the hydraulic pulse 112 will have a duration determined by the R-C time constant which in turn is determined by the resistance of restriction orifice 92 and the capacitance of the chamber 58. Thus when the chamber 58 is filled (depending further upon the spring rate of the spring 64) fluid under pressure ceases flowing through the passageway 90 and into the chamber 58. That is, effectively the fully charged capacitance of the chamber 58 will appear as an infinite resistance or open circuit. When such occurs, fluid pressure from the outlet port 18 connected as a negative feedback signal via the passageway 94 and through the series restriction orifices 92 and 96 to the control port 22 becomes dominant. The series resistance of the restriction orifices 92 and 96 is less than the resistance of the restriction orifice 89 and thus the pressure signal appearing at the nozzle 106 connected to the control port 22 interacts with the power stream in such a way as to deflect it away from the outlet port 18 and to the outlet port 16. That is, the combination of the resistances of the restriction orifices and the negative and the positive paths are such that the resistance is greater in the positive feedback path than in the negative feedback path thereby causing the power stream to be moved from the outlet port 18 to the outlet port 16.

Upon appearance of the fluid pressure signal at the outlet port 16, the fluid flows through the restriction orifice 82 and the passageway 80 and enters the chamber 56 thereby causing the spool valve 30 to move upwardly as viewed in FIG. 1. The remainder of the operation is as above described. The fluid which filled chamber 58 reverses its flow direction through passageway 90, restriction orifice 92, outlet port 18, into the interaction chamber 24 and out the exhaust port 26 to ambient or return 106. Upon the reversal of the spool valve 30, outlet port 36 is opened by land 40 to receive hydraulic fluid under pressure from source 42. At the same time, port 34 is opened to return 54 by land 38. As a result, an output signal appears at $C_2$ as shown at 114 in FIG. 2 and simultaneously therewith, the signal 112 returns to zero (return pressure) as is illustrated.

The frequency of the pulses 112–114 appearing at the output of the reciprocal valve means 12 can be controlled to any desired frequency depending upon the particular application to which the oscillator is being put. Such frequency control can be obtained by changing parameters such as the spring rate of the springs 64–68, the volume of the chambers 56–58, the resistance of the restriction orifices 82–92, the pressure of the source 100, the resistance of the variable restriction orifice 104, or the resistance of the feedback orifices 86, 96, 89 and 99. Through utilization of the chambers 56 and 58 and the restriction orifices 82 and 92, it will be recognized by those skilled in the art that the frequency of oscillation is quite low compared to the natural frequency of oscillation of a momentum exchange fluidic amplifier connected to function as an oscillator. Typically, through utilization of the hydrofluidic oscillator of the present invention, frequencies below 1 Hertz are achieved.

What is claimed is:

1. An adjustable low frequency hydrofluidic oscillator comprising:

A. Reciprocal valve means (12) for providing discrete output fluid pulses (112–114) responsive to application of fluid pressure signals thereto and including chamber means (56–58) within which said fluid pressure signals are received;

B. Momentum exchange fluidic amplifier means (10) having an interaction chamber (24) defining an input (14), first (20) and second (22) control, and first (16) and second (18) output ports; and C. Passageway means (80, 84, 98 and 90, 94, 88) coupling each of said output ports (16–18) to each of said control ports (20–22) and to said chamber means (56–58) for providing simultaneously a fluid pressure signal to said chamber means (56–58) and a positive and negative feedback signal to said first (20) and second (22) control ports respectively.

2. An adjustable low frequency hydrofluidic oscillator as defined in claim 1, wherein said passageway means providing said positive and negative feedback signals each includes flow restrictor means therein, said flow restrictor means in said positive feedback passageway means providing a greater restriction to flow than the flow restrictor means in said negative feedback passageway means.

3. An adjustable low frequency hydrofluidic oscillator as defined in claim 2, wherein said reciprocal valve means is a spring-centered spool valve disposed within a cylinder and said chamber means is a separate end chamber disposed one at each end of said spool valve, said passageway means coupling said first output port to a first one of said end chambers and said second output port to a second one of said end chambers.

4. An adjustable low frequency hydrofluidic oscillator as defined in claim 3, wherein said spool valve is a four-way spool valve.

5. An adjustable low frequency hydrofluidic oscillator as defined in claim 4, wherein said passageway means includes a first passageway inter-coupling said first control port, said first output port, and said first chamber; a second passageway inter-coupling said second control port, said second output port, and said second chamber; a third passageway inter-coupling said first output port and said second control port, and a fourth passageway inter-coupling said second output port and said first control port.

6. An adjustable low frequency hydrofluidic oscillator as defined in claim 5 which further includes frequency adjusting means coupled to said input port.

7. An adjustable low frequency hydrofluidic oscillator as defined in claim 6 wherein said frequency adjusting means is a variable flow restrictor.

8. An adjustable low frequency hydrofluidic oscillator as defined in claim 7 wherein said interaction chamber further defines an exhaust port and further includes additional passageway means connecting said exhaust port to ambient pressure.

9. An adjustable low frequency hydrofluidic oscillator as defined in claim 1 which further includes frequency adjusting means coupled to said input port.

10. An adjustable low frequency hydrofluidic oscillator as defined in claim 9 wherein said frequency adjusting means is a variable flow restrictor.

11. An adjustable low frequency hydrofluidic oscillator as defined in claim 10 wherein said interaction chamber further defines an exhaust port and further includes additional passageway means connecting said exhaust port to ambient pressure.

* * * * *